US005516172A

United States Patent [19]

Ehrlich

[11] Patent Number: 5,516,172

[45] **Date of Patent: * May 14, 1996**

[54] CONTAINER LIFTING DEVICE

[76] Inventor: Rodney P. Ehrlich, 1903 Tippecanoe Springs Rd., Monticello, Ind. 47960

[ * ] Notice: The portion of the term of this patent subsequent to Jun. 7, 2011, has been disclaimed.

[21] Appl. No.: 129,737

[22] Filed: Sep. 30, 1993

Related U.S. Application Data

[63] Continuation-in-part of Ser. No. 981,509, Nov. 25, 1992, Pat. No. 5,318,335.

[51] Int. Cl.[6] ..... B65D 90/00

[52] U.S. Cl. ..... 294/68.1; 294/68.3; 220/1.5

[58] Field of Search ..... 294/68.1–68.3, 294/81.1, 81.51, 81.54; 220/1.5

[56] References Cited

U.S. PATENT DOCUMENTS

| | | | |
|---|---|---|---|
| 1,727,685 | 9/1929 | Willoughby | 294/68.1 X |
| 1,760,305 | 5/1930 | Fildes | 294/68.24 X |
| 1,875,702 | 9/1932 | Butts | 294/68.2 |
| 3,262,729 | 7/1966 | Willison et al. | 294/68.3 |
| 4,810,027 | 3/1989 | Ehrlich | 296/181 |
| 5,072,845 | 12/1991 | Grogan | 220/1.5 |
| 5,332,274 | 7/1994 | Baumann | 294/68.3 |

*Primary Examiner*—Dean Kramer

[57] ABSTRACT

Freight container construction having opposing body side panels, adapted for lifting by an overhead crane includes lifting support structures which are exteriorly secured to and transfer the lifting load to the panels. Couplers formed on the lifting support structures are disposed exteriorly adjacent to the panels which bear the lifting load.

11 Claims, 5 Drawing Sheets

238
218a
218
236
250
230
232
212
219
214
215
221
234
234a
220
210
217

239
236a
222
260

250
222
219
221'
215a
232
234

CONTAINER LIFTING DEVICE

CROSS REFERENCE TO RELATED APPLICATION

This application is a Continuation-in-Part of application Ser. No. 07/981,509 filed Nov. 25, 1992 now U.S. Pat. No. 5,318,335.

BACKGROUND OF THE INVENTION

The present invention relates generally to overhead lifting of freight trailer containers, and more particularly relates to the structure of lifting supports provided on the container body assemblies.

Roadway trailer containers and other containerized freight which are loaded onto railroad or even ship transport using overhead lifting cranes have required the construction of the container body itself to withstand the overhead lifting load. When the crane is coupled to couplers on the top of the container, the coupler structures have required the container construction to provide extensive framework to distribute the load from the four coupled "top pick points" provided on the roof of the container. Conventionally, the top pick points or lifting coupler structures have required projection and reinforcement within the body of the container which reduces the available freight volume. The present invention eliminates the foregoing disadvantages.

SUMMARY OF THE INVENTION

In accordance with the present invention, freight container construction having opposing body side panels, adapted for lifting by an overhead crane includes lifting support structures which are exteriorly secured to and transfer the lifting load to the panels. Couplers formed on the lifting support structures are disposed exteriorly adjacent to the panels which bear the lifting load.

In one embodiment, the lifting support structure has a base which is secured to an exterior surface of the body side panel and transfers the lifting load to the side panel, and a pocket structure is secured to the base structure so that the pocket extends outwardly from the base structure and receives a coupling member from the crane without any of the pocket structure projecting interior to the body side panel.

In another embodiment, the lifting support structures have a corner-shaped configuration mounted over a top rail of a plate-type container side panel so that a first leg of the corner configuration is secured to the vertical plate and a second leg of the corner configuration is secured upon the roof.

DESCRIPTION OF THE ILLUSTRATED EMBODIMENT

Figure 1:
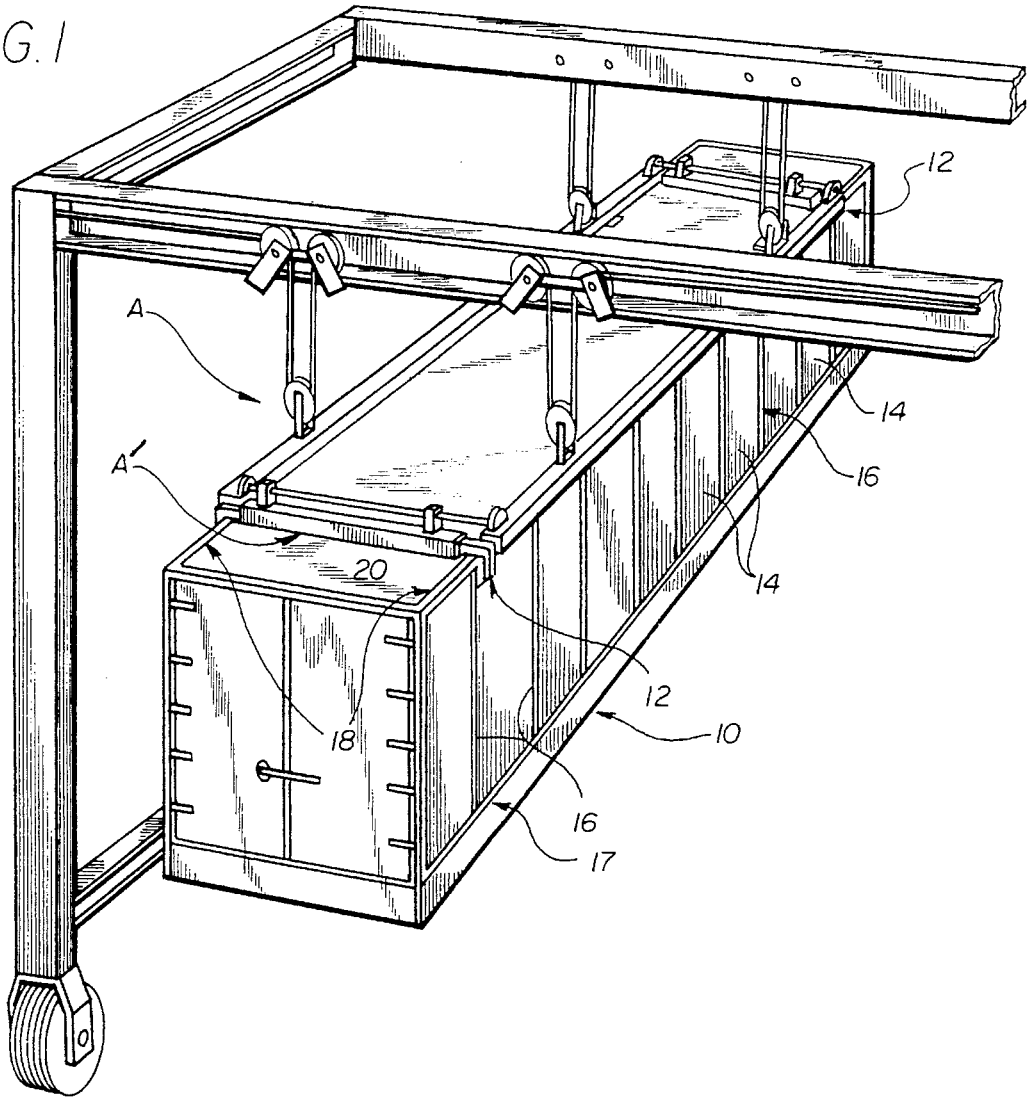
FIG. 1 is a perspective view of one embodiment of a container and lifting structure in accordance with the invention, coupled for overhead lifting by a crane.
Figure 2:
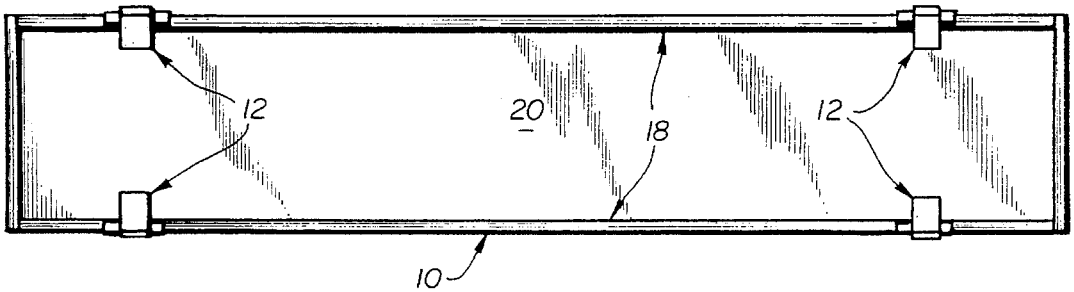
FIG. 2 is a top plan view of the container shown in FIG. 1.

Referring to FIG. 1, one embodiment of a freight container structure in accordance with the present invention is generally designated by reference character 10 and shown being lifted by a typical overhead crane structure A. The crane A can have a lifting frame structure A' which is coupled to four lifting supports 12 or "top picks" on the top of the container 10 as best shown in FIG. 2.

In the illustrated embodiment, the sides of the body of the container 10 are assembled from multiple pairs of vertical plates 14 supported by vertical posts 16, for example as described in U.S. Pat. No. 4,810,027 which is incorporated by a reference for discussion of particularly preferred side panel construction. A top rail 18 extends the entire length of the assembled plates 14 and posts 16 for supporting the plates 14 and securing the roof 20. A floor assembly (not shown) is secured to the lower frame 17. As shown in FIGS. 1 and 2, the lifting supports 12 are paired in alignment across the roof 20 and secured at the shoulders formed by the respective rails 18. Each of the supports 12 is located between consecutive posts 16. The two supports 12 can be spaced for example approximately 40 feet on a side of the body having a length for example of 53 feet, in order to provide four-point lifting stability using an overhead crane.

Figure 3:
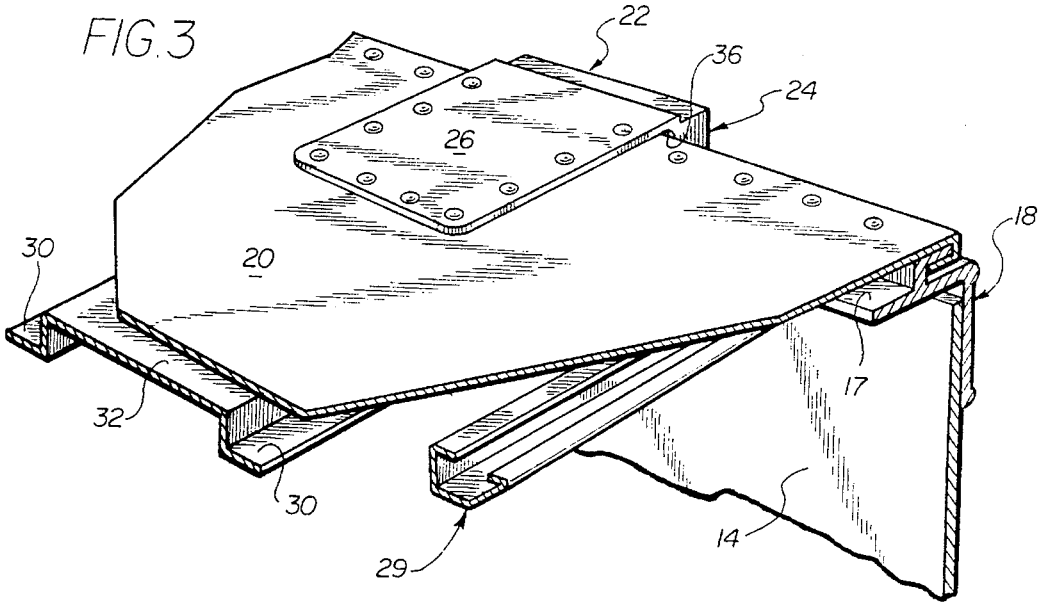
FIG. 3 is a perspective, fragmentary view broken away from the container shown in FIGS. 1 and 2 for illustration of the container construction cooperating with the lifting structures.
Figure 6:
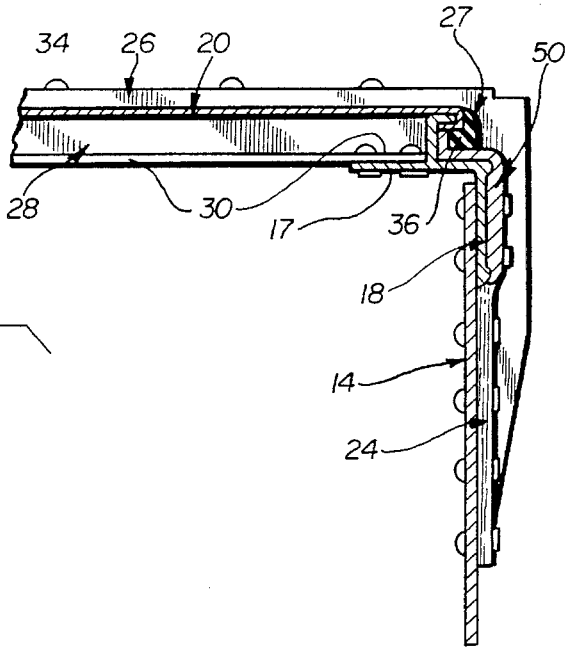
FIG. 6 is a sectional view along a plane indicated by line 6—6 in FIG. 4.

Referring now to FIGS. 3–8, each of the lifting supports 12 includes a corner shaped casting 22 including a first leg 24 which is riveted to the exterior surface of the plate 14 and the second leg 26 which is riveted through the roof 20 into a reinforcing brace member 28 which transversely supports opposing plates 14 forming the opposite side panels of the container body 10. As best shown in FIGS. 3 and 6, in the illustrated embodiment, the brace or header 28 includes spaced mounting webs 30 which are riveted to the inwardly projecting flange portion 17 of the top rail 18. The elevated, central panel 32 of the brace 28 supports the roof and secures the riveted second leg 26 of each of the opposing castings 22 of the supports 12. Preferably, the brace members 28 are fabricated from ⅛-inch steel in order to support the dead load of the crane frame A' prior to coupling, (in comparison to the conventional aluminum roof bows 29 provided in the container 10).

Figure 4:
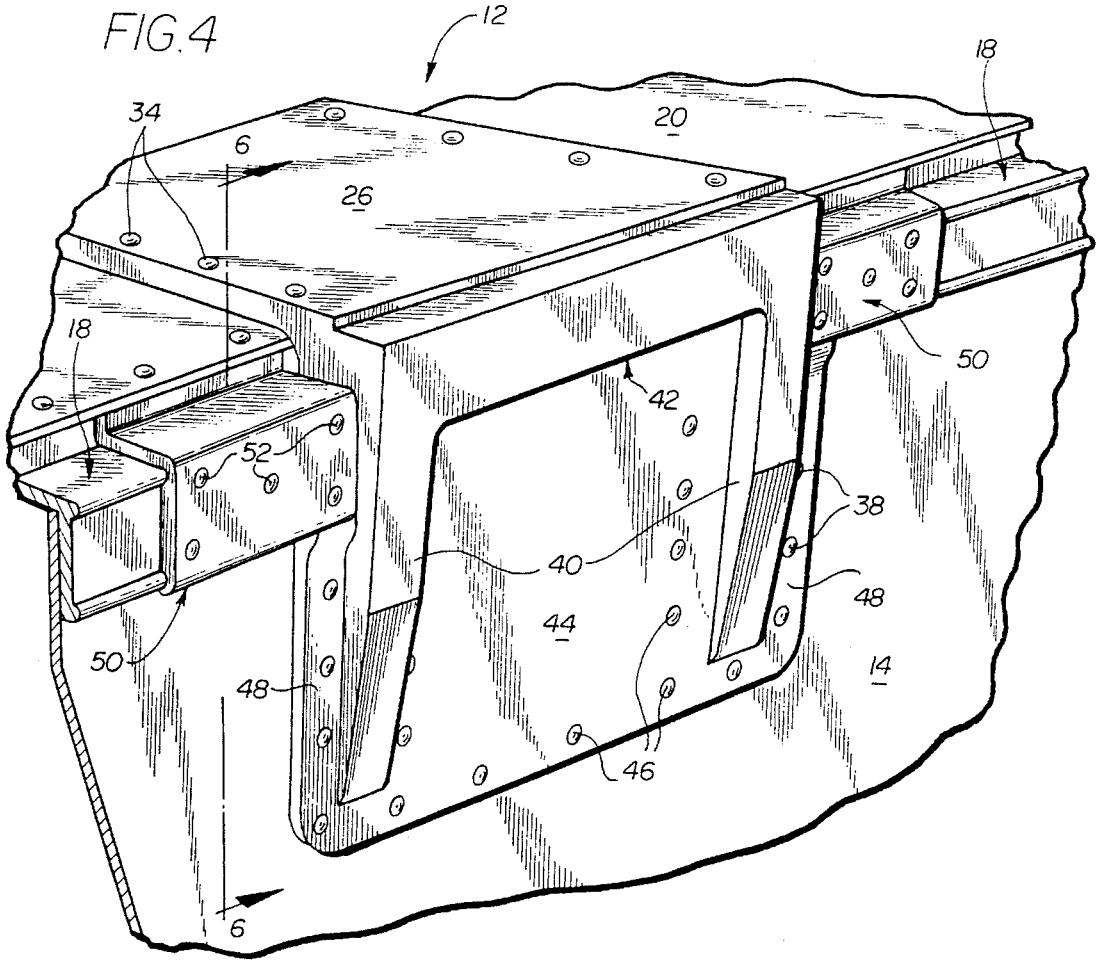
FIG. 4 is an enlarged perspective side view of the container and lifting structure shown in FIGS. 1–3.
Figure 5:
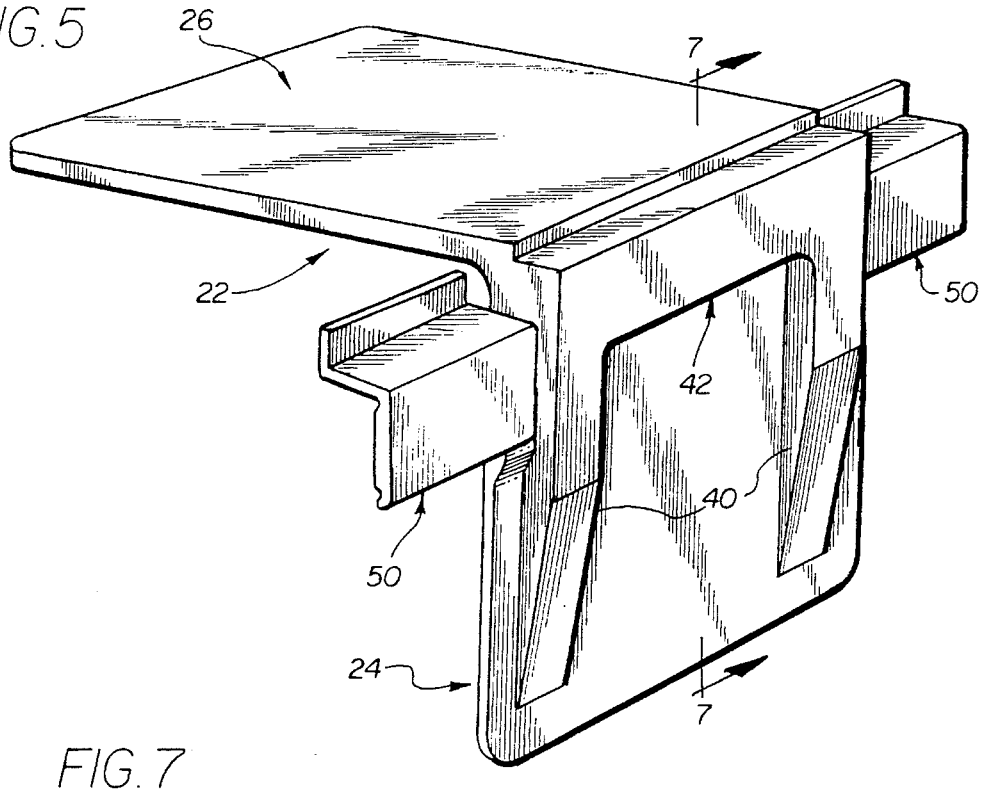
FIG. 5 is a perspective view of the corner casting portion of the lifting structure shown in FIGS. 1–4.
Figure 7:
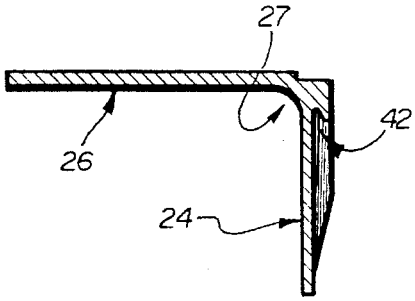
FIG. 7 is a sectional view along a plane indicated by line 7—7 in FIG. 5.

The curved elbow portion 27 of the casting 22 compresses a rubber weather seal 36 against the top rail 18 as best shown in FIG. 4. The first, vertical leg 24 of the casting 22 is riveted at 38 into the supporting vertical plate 14 which is preferably at least 0.16-inch thick aluminum so that the plate 14 bears the tensile load of the overhead lifting by the crane. The lifting structures 12 thus benefit from the structural integrity of the 0.16-inch aluminum plate for support without requiring additional frame reinforcement. Alternatively, container wall construction employing integral sheet panels of sufficient gauge can also bear the tensile load transferred by the similarly secured lifting structures 12.

Figure 8:
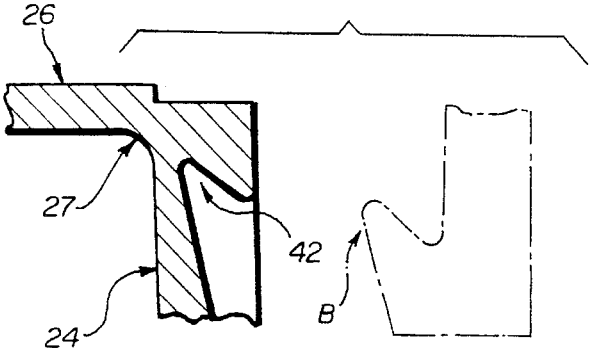
FIG. 8 is an enlarged, fragmentary sectional view of a coupling hook portion of a lifting support shown in FIG. 7.

Outwardly projecting from the leg 24 is an integral, generally three-sided boss portion of the casting 22 which includes two spaced, vertically extending arms 40 which generally taper downwardly from an upper span 42 having a hooked cross sectional configuration as best shown in FIG. 8. Referring again to FIG. 4, the arms 40 and the medial leg surface 44 therebetween serve to guide a complementary hook member B (FIG. 8) of the crane A into mating engagement with the upper span casting hook 42 in the coupling action preparatory to overhead lifting operations. Accordingly, the rivet heads 46 are flush with the medial surface 44, whereas the rivets 38 through the lateral flange portions 48 as well as the rivets 34 into the roof 20 and brace 32 can have heads of truss or other configuration for greater purchase. For additional lateral reinforcement, a pair of reinforcing caps 50 are welded to and straddle the vertical casting leg 24 and are rivetted at 52 into the top rail 18.

The elongate hook configuration 42 projecting slightly outwardly from the vertical casting leg 24 enables the lifting supports 12 to suppress any twisting movement from the overhead lifting operation, as well as to have a low-height clearance and sturdy lateral profile, although alternative coupling configuration can be provided in coordination with other crane couplers.

Figure 9:
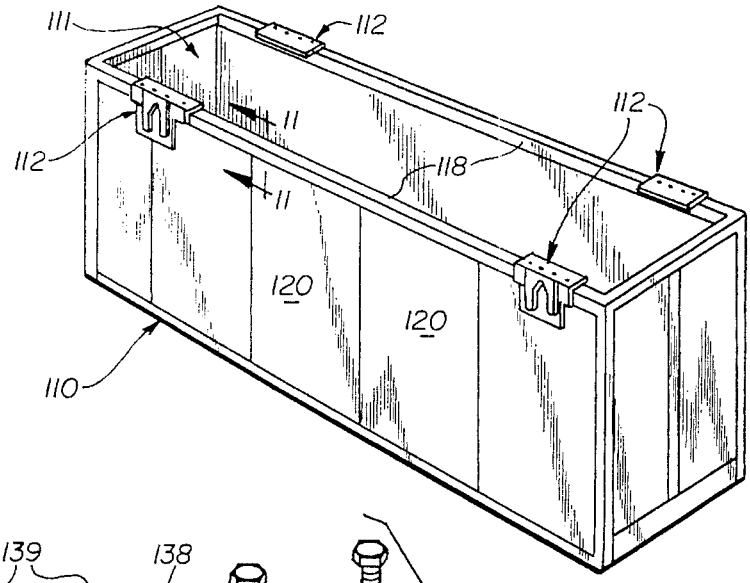
FIG. 9 is a perspective view of another embodiment of a container and lifting structure in accordance with the invention.
Figure 10:
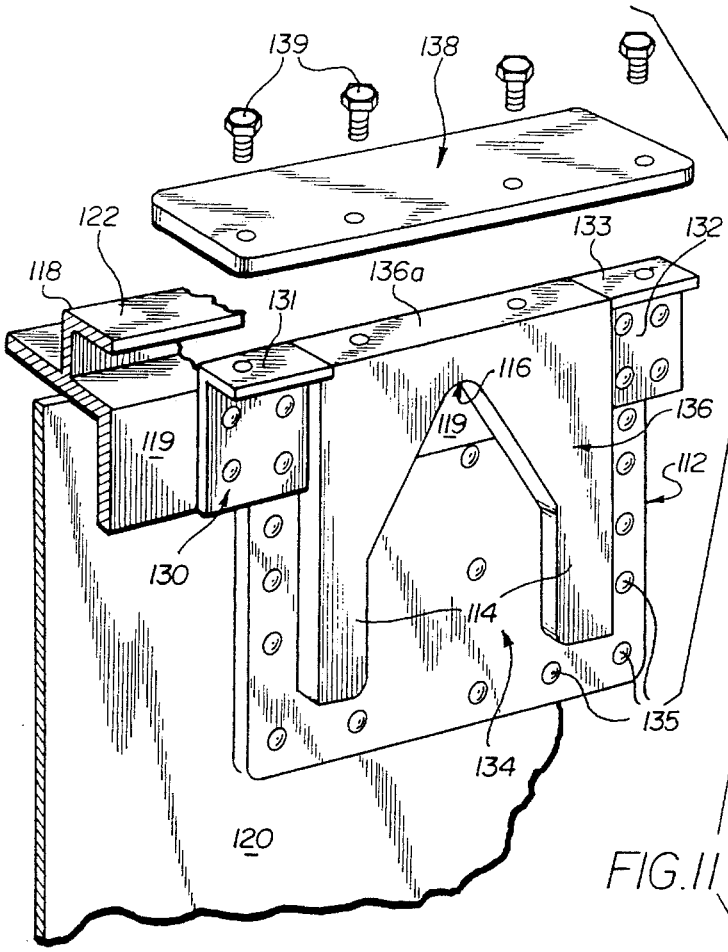
FIG. 10 is a partially exploded and fragmentary view of the lifting and container structures shown in FIG. 9.
Figure 11:
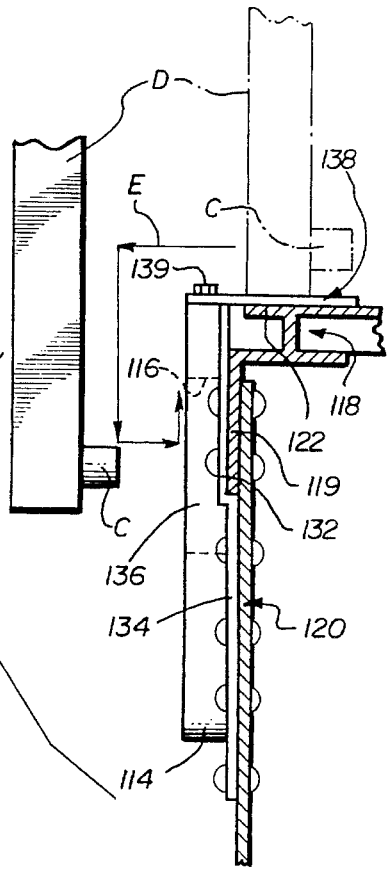
FIG. 11 is a partial sectional view of the container and lifting structures of FIGS. 9 and 10, also showing diagrammatic cooperation with a lifting arm of an overhead crane.

Referring now to FIGS. 9–11, another embodiment of a lifting support structure generally designated by reference character 112 is shown mounted on a freight container structure 110 in accordance with the present invention as shown in FIG. 9. As illustrated in FIG. 9, the container structure 110 can be roofless with an open top 111. In this embodiment, the lifting structure 112 has a base or mounting plate 134 on which is welded an inverted V-shaped casting pocket 136 which has an arcuate vertex forming a seat 116 which is configured to be coupled by a generally cylindrical coupling pin C at the lower end of the lifting crane arm D. The casting seat and crane coupler can have any suitable mating configurations. The pocket 136 has spaced, depending arms 114 which provide guidance for alignment of the coupling pin C into the pocket 136 and engagement with the seat 116. The pocket 136 can be partially offset relative to the baseplate 134 so that the seat 116 is actually formed as a through opening which is closed at the back by the vertical flange 119 of the top rail 118 described hereinafter. Thus, the top rail 118 is not interrupted and its continuous fiber is not impaired.

The mounting base plate 134 is riveted at 135 supported by a body side wall plate 120 which bears the tensile load transmitted by the lifting structure 112 in lifting the container structure 110 by the overhead crane. In the illustrated embodiment, the plate 120 is secured at its upper end to the vertical flange 119 of a typical top rail 118. Preferably, the base plate 134 is abbreviated to flushly abut the vertical top rail flange 119, and the lifting structure has two flanges 130 and 132 which are welded to the sides of the pocket casting 136 and are also riveted into the vertical rail flange 119 for lateral stability in lifting the container or trailer structure 110.

An elongate horizontal crane loading pad 138 is riveted at 139 to horizontal top surface **136*a* of the pocket casting 136 and the flush horizontal tabs 131 and 133 of the side flanges 130 and 132. The pad 138 is thus easily replaceable. In the illustrated embodiment, the pad 138 is also supported by the upper horizontal web 122 of the rail 118 as best shown in FIG. 11. The pad 138 provides a landing support for the initial vertical approach of the crane arm D (as shown in the phanton position in FIG. 11) prior to the coupling motions as indicated by directional arrow E to begin the coupling of the pin C into the pocket 136 for lifting engagement against the seat 116** as previously described.

Figures 12, 13, 14, 15:
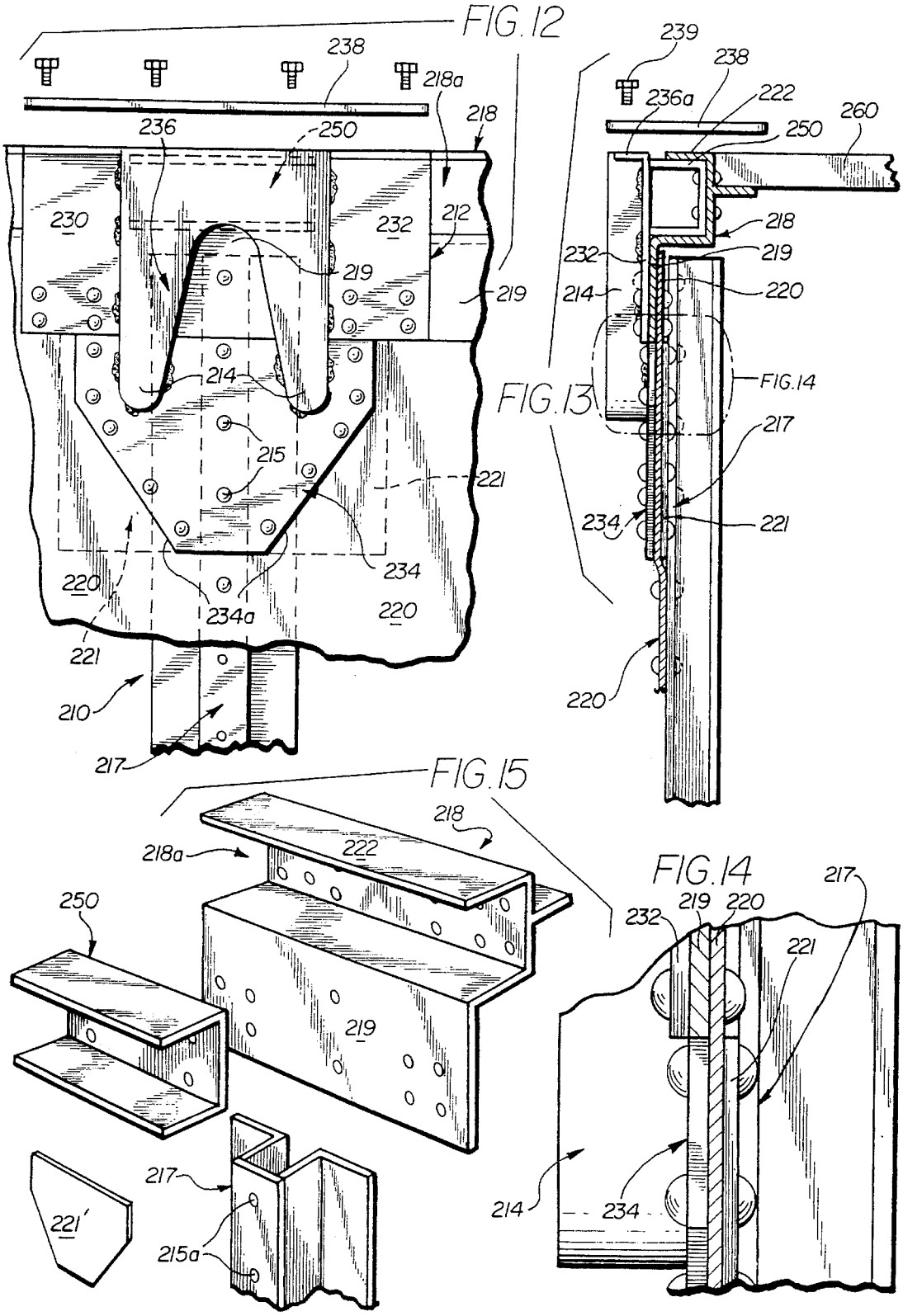
FIG. 12 is a partially fragmentary elevational view of another embodiment of the lifting and container structures in accordance with the invention.
FIG. 13 is a partial sectional view of the lifting and container structures shown in FIG. 12.
FIG. 14 is an enlarged view of an indicated portion from FIG. 13.
FIG. 15 is a fragmentary, exploded view of a portion of the container wall structure shown in FIGS. 12–14.

Referring now to FIGS. 12–14, another embodiment of the container structure in accordance with the invention is generally designated by reference numeral 210 in which the body side wall has a conventional sheet and post construction. The generally thinner wall sheet or skin 220 having a thickness typically of 0.032 to 0.050 inch is reinforced by a similar thickness of added reinforcing panel 221 so that the combined wall gauge has sufficient gauge and integrity to bear tensile loads transferred by four of the lifting structures 212 as previously described, during overhead crane lifting operations. As shown in FIG. 12, the lifting structure 212 has essentially the same construction and configuration as the previously described lifting structure 112, with the exception that the base plate 234 has angled side edges **234*a***.

In the container structure 210, the adjoining sheet wall sections 220 are lapped and riveted at 215 through holes **215*a* in the medial web of a vertical post 217. The welded side flanges 230 and 232 are riveted through respective sheets 220 into the vertical web 219 of top frame rail 218 as best shown in FIGS. 12 and 13. As shown in FIG. 14, when the top rail 18 is provided with a horizontal channel recess 218*a*, a channel member 250 is fitted and riveted therein to stabalize lateral forces behind the lifting structure 212 which has been omitted from FIG. 15 for clarity. The reinforcing sheet panel 221' can be mounted on the exterior surface of the wall skin 220 underneath the base plate 234 and can have angled edges congruent therewith so that the panel 221'** is unexposed.

The horizontal pad 238 for supporting the crane arm (not shown) is riveted at 239 into the upper surface **236*a* of the pocket 236 as shown in FIG. 13. Since the lifting structure 212 thus supports the landing pad 238 and the crane arm, the roof structure 260, if present, need not support the crane arm. Furthermore, roof bracing is unnecessary because the lifting load is entirely borne by the side wall and stabilized by the upper rail which does not require any modifications for mounting of the lifting structure 212**. Additionally, any side wall deflections in the overhead lifting operation are not transmitted to a roof struture, avoiding fatigue therefrom. Thus the lifting structure can be retrofitted onto most currently used trailers and containers, or incorporated into manufacture of new constructions.

While particular embodiments of the present invention have been described herein, it will be obvious to those skilled in the art that changes and modifications in various aspects may be made without departing from the broad scope of the invention. Consequently, the scope of the invention is not limited by any particular embodiment but is defined by the appended claims and the equivalents thereof.

In the claims, the term "container structure" is intended to refer to all types of containers including those adapted to be detachably mounted on a separate trailer chassis and those which are incorporated into a trailer structure.

The invention is claimed as follows:

1. A lifting support structure for mounting on a freight container having opposite side wall panels, which is to be coupled and lifted by an overhead crane, said support structure comprising: a base for securement to an exterior surface of one of said side wall panels and transfer of lifting load thereto, and a pocket means secured to said base and extending outwardly therefrom for receiving a coupling member from the crane without any structure projecting interior to said side wall panel, further comprising a landing pad means for supporting a linkage portion of said crane prior to said coupling member reception wherein said landing pad means is removably mounted on said lifting support structure.

2. A lifting support structure according to claim 1, wherein said landing pad means is arranged on an upper peripheral surface of said pocket means.

3. A lifting support structure according to claim 1, wherein said base has a planar rear surface for seated securement against flat exterior surface of said side wall panel.

4. A lifting support structure according to claim 1, wherein said pocket means comprises a through aperture for insertion of said crane coupling member.

5. A lifting support structure according to claim 1, wherein said pocket means comprises an inverted V-shape configuration and vertex thereof forming a seat for receiving said crane coupling member.

6. A lifting support structure according to claim 1 in combination with said freight container, wherein each said side wall panel includes an assembly of adjacent vertical plates joined by supporting vertical posts, said lifting support structure being secured to one of said plates bearing said lifting load.

7. A lifting support structure according to claim 6, further comprising a top rail secured to upper ends of said side wall panels, said lifting support structure being additionally secured to said top rail without interruption thereof.

8. A lifting support structure for mounting on a freight container having opposite side wall panels, which is to be coupled and lifted by an overhead crane, said support structure comprising: a base for securement to an exterior surface of one of said side wall panels and transfer of lifting load thereto, coupling means secured to said base and extending outwardly therefrom for receiving a coupling member from the crane without any structure projecting interior to said side wall panel, further comprising a landing pad means for supporting a linkage portion of said crane prior to said coupling member reception wherein said landing pad is removably mounted on said lifting support structure.

9. A lifting support structure according to claim 8, wherein said landing pad means is arranged on an upper peripheral surface of said coupling means.

10. A lifting support structure according to claim 8 in combination with said freight container, wherein each said side wall panel includes an assembly of adjacent vertical plates joined by supporting vertical posts, said lifting support structure being secured to one of said plates bearing said lifting load.

11. A lifting support structure according to claim 8 in combination with said freight container and further comprising a top rail secured to upper ends of said side wall panels, said lifting support structure being additionally secured to said top rail without interruption thereof.

* * * * *

UNITED STATES PATENT AND TRADEMARK OFFICE

CERTIFICATE OF CORRECTION

PATENT NO. : 5,516,172

DATED : May 14, 1996

INVENTOR(S) : Rodney P. Ehrlich

It is certified that error appears in the above-indentified patent and that said Letters Patent is hereby corrected as shown below:

On the Title page, Item [73] "Assignee" should read as follows:

-- WABASH NATIONAL CORPORATION --

Signed and Sealed this

Third Day of September, 1996

*Attest:*

Bruce Lehman

BRUCE LEHMAN

*Attesting Officer*

*Commissioner of Patents and Trademarks*